United States Patent [19]

Allen

[11] Patent Number: 4,640,349

[45] Date of Patent: Feb. 3, 1987

[54] FLEXIBLE SUCKER ROD UNIT

[75] Inventor: Loy F. Allen, Odessa, Tex.

[73] Assignee: Allen and Bennett, Inc., Odessa, Tex.

[21] Appl. No.: 745,285

[22] Filed: Jun. 14, 1985

[51] Int. Cl.[4] ..... E21B 17/10

[52] U.S. Cl. ..... 166/68.5; 166/241

[58] Field of Search ..... 166/68.5, 105, 176, 166/241; 308/4 A, 6 A; 403/343, 306, 307, 299, 296; 285/333, 334, 355, 390; 175/325

[56] References Cited

U.S. PATENT DOCUMENTS

| | | | |
|---|---|---|---|
| 1,539,287 | 5/1925 | Wilson | 285/333 |
| 1,605,316 | 11/1926 | Wilson | 175/325 |
| 1,607,941 | 11/1926 | Bowser | 175/325 |
| 2,162,426 | 6/1939 | Fitzpatrick | 175/325 |
| 2,725,264 | 11/1955 | Bodine, Jr. | 308/4 A |
| 2,754,160 | 7/1956 | Owen | 166/241 |
| 2,793,917 | 5/1957 | Ward | 308/4 A |
| 3,490,526 | 1/1970 | Collett | 308/4 A |
| 3,560,060 | 2/1971 | Morris | 308/4 A |

FOREIGN PATENT DOCUMENTS

| | | | |
|---|---|---|---|
| 0003250 | of 1915 | United Kingdom | 403/343 |

*Primary Examiner*—Stephen J. Novosad
*Assistant Examiner*—Bruce M. Kisliuk
*Attorney, Agent, or Firm*—Wendell Coffee

[57] ABSTRACT

A flexible coupler is provided for the sinker bars of the sucker rod string of a deep oil well. The coupling unit has a flexible section so that the coupling will flex to a greater extent than the sinker bars. The coupling also has a cylindrical bearing surface which is as large as will slide through the eduction tube freely. The bearing surface has longitudinal grooves for the passage of fluid. The coupling itself has a cylindrical friction fit between the pin and the box to help prevent unscrewing of the unit as well as the radial faces which are torqued to API specifications against one another.

5 Claims, 10 Drawing Figures

FLEXIBLE SUCKER ROD UNIT

BACKGROUND OF THE INVENTION (1) Field of the Invention

This invention relates to producing oil wells, and more particularly to wells having reciprocating pumps operating from the surface by sucker rods.

(2) Description of the Prior Art

Pumping oil wells with a reciprocating pump at the bottom of the well and a sucker rod extending through an eduction tube is old and well know.

Traditionally, a sucker rod string was composed of a series of metal rods about 25 to 30 feet long, having a male or threaded pin connection at each end. They were connected together by cuffs, i.e., a coupling having a female or internally threaded cup at both ends.

In recent years, there has been considerable use of synthetic materials such as fiberglass rods. These strings are often several hundred feet long. It has been found that with the use of fiberglass rods that it is necessary or essential that they never be permitted to come under compression loads while in use. Therefore, it is necessary when using the fiberglass rods, because of their light weight, to attach sinker barsat the lower end of the sucker rod string. These sinker bars are normally joints about 25 to 30 feet long having a square or cylindrical cross section and a threaded pin or box connection on each end.

The couplings or cups by which the sinker bars are connected have a cylindrical configuration with the diameter of the cylindrical configuration greater than the diagonal width of diameter of the square or cylindrical sinker bar cross section. Therefore, the sinker bars themselves would not contact the eduction tube but would normally be held away from contact with the eductiontube by the couplings.

Often times, the pump is far below the surface of the earth, e.g., 5,000 feet. Normally, standard size eduction tubs are used having standard internal diameters. However, those familiar with oil field operation will understand that often, because of rough treatment or otherwise, that not every joint of the eduction tube will be cylindrical throughout its length and of uniform inside diameter. Therefore, to physically insert a cylindrical element through the tube, it must be of somewhat smaller diameter than the internal diameter of an "undamaged" eduction tube.

It will be understood that the eduction tube is often not vertically straight. Often, because of drilling, it will have bends, curves, or corkscrews in it. So, normally the coupling would keep the sinker bar from contact with the eduction tube. The couplings are flexible to bend in a crooked eduction tube because the sinker bars cannot bend enough.

However, the sucker rod would not be axially aligned with the eduction tube. This causes problems particularly at the pump. The pump and the plunger of the pump is by necessity held in axial alignment with the eduction tube. If the sucker rod above the pump is not axially aligned, there is a problem of excessive wear at points of contact and at the pump, which is an existing problem in the industry.

In addition, there is always the possibility that threaded connections become unthreaded and the sucker rod string parted for this reason; i.e., sometimes the sucker rod string or elements of it break apart. In such cases it is necessary to "fish" the parts from the well.

Before this application was filed, the applicant caused a search to be made in the U.S. Patent and Trademark Office. The following patents were found on that search:

| NAME | FILING DATE | ISSUE DATE | NUMBER |
|---|---|---|---|
| KINNY | Jul. 5, 1932 | Jul. 28, 1936 | 2,049,265 |
| PARAMORE ET AL. | May 4, 1981 | Feb. 14, 1984 | 4,430,787 |
| SABLE | May 18, 1966 | Dec. 3, 1968 | 3,414,337 |
| JEVNING - CANADIAN | Jun. 10, 1967 | Dec. 3, 1968 | 800,390 |
| SMITH | Oct. 3, 1949 | Sept. 15, 1953 | 2,652,231 |
| MORRIS | Dec. 18, 1968 | Feb. 2, 1971 | 3,560,060 |
| COLLETT | Jan. 30, 1968 | Jan. 20, 1970 | 3,490,526 |
| WILLIAMS | Feb. 28, 1938 | Sep. 12, 1939 | 2,172,602 |
| PRIDY | Aug. 25, 1980 | May 11, 1982 | 4,329,124 |
| SOULIE ET AL. | Feb. 11, 1971 | Oct. 10, 1972 | 3,697,104 |
| BURGE | Mar. 19, 1982 | Aug. 28, 1984 | 4,467,879 |
| KNUTSEN | Oct. 6, 1981 | May 31, 1983 | 4,385,669 |
| BOICE | Jul. 5, 1946 | Dec. 29, 1953 | 2,664,272 |

KINNY discloses a sucker rod coupling having a bearing made of stellite.

PARAMORE ET AL., SABLE, JEVNING, SMITH, MORRIS, and COLLETT all describe sucker rods with guides or centralizers or the like.

WILLIAMS, PRIDY, SOULIE ET AL., BURGE, KNUTSEN, and BOICE are included herewith only because the applicant believes the Examiner would consider anything revealed by an experienced patent searcher to be relevant and pertinent to the examination of this application.

SUMMARY OF THE INVENTION (1) New Functions and Surprising Results

I have invented a flexible rod unit for the sinker bars of a sucker rod string which has a bearing to centralize the string at the sinker rods which will be immediately above the pump. I.e, not only does it prevent the outer edges of the coupling cups or threaded portions from wearing against the side of the eduction tube, but it also centralizes or aligns the sucker rod string with the pump for better operation with less wear. This bearing is made for each particular size of eduction tube and sucker rod pin size.

Also, as discussed above, there is always some problem of the couplings becoming unthreaded. Normally the couplings are tightened to a friction fit of the radial face between the pin and the cup end. I have discovered that it is efficient to also taper the thread stress-relief diameter to maximum diameter at the pin face at the distal end of the cup.

(2) Objects of this Invention

An object of this invention is to pump fluids from a well.

Another object of this invention is to improve the sucker rod string by which pumps on the bottom of eduction tubes are operated.

Further objects are to achieve the above with devices that are sturdy, compact, durable, simple, safe, efficient, versatile, ecologically compatible, energy conserving, and reliable, yet inexpensive and easy to manufacture, connect, adjust, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
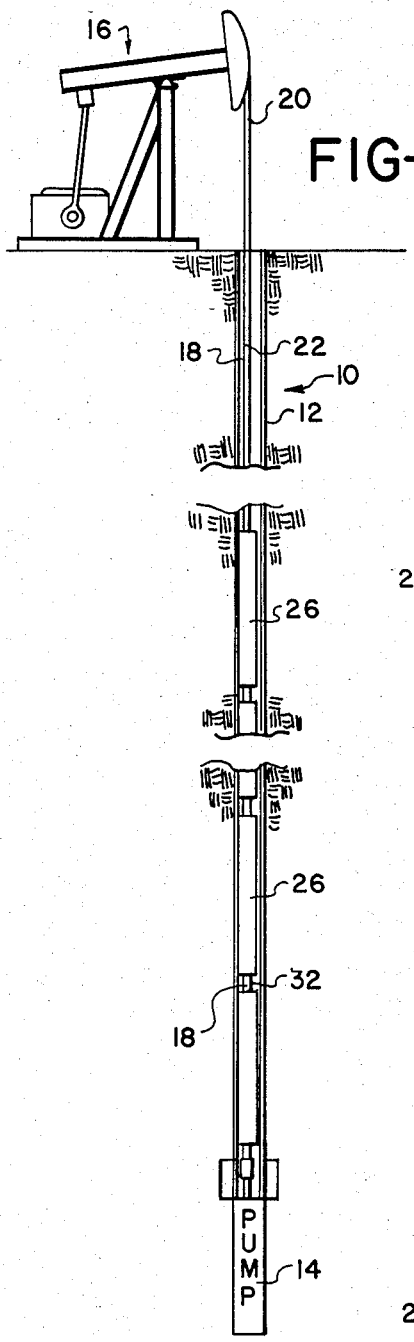
FIG. 1 is a schematic representation of the pumping units of a producing oil well.
Figure 9:
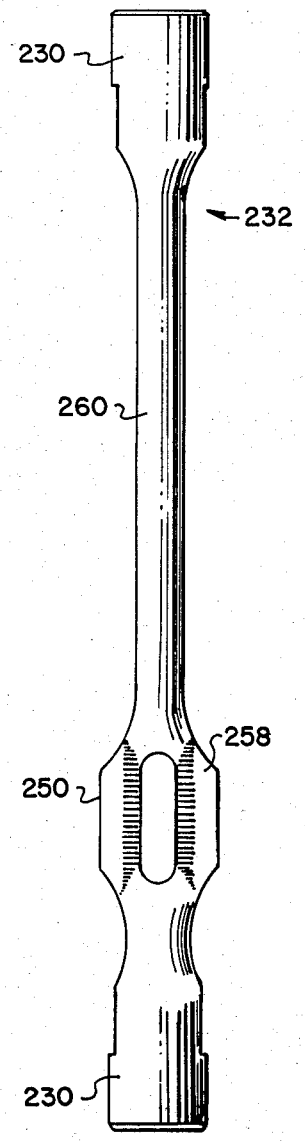
FIG. 9 is an elevational view of the rod unit shown in FIG. 2.
Figure 2:
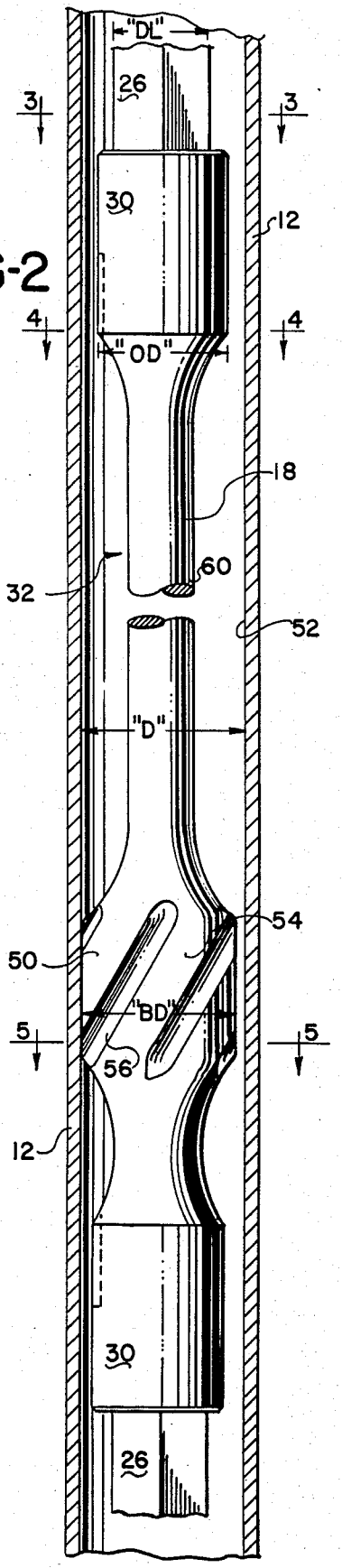
FIG. 2 is a elevational view of a rod unit according to this invention connected to sinker bars within an eduction tube which is cut away for clarity.
Figure 10:
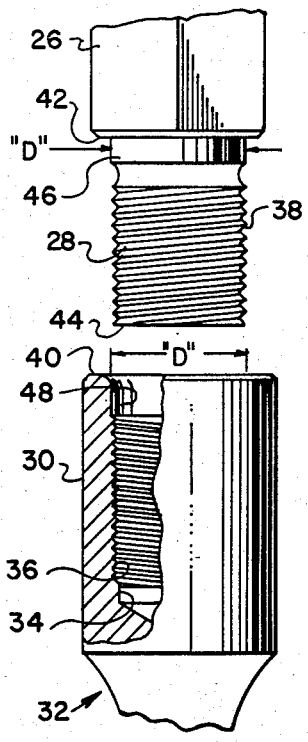
FIG. 10 is a break-away view of a pin and cup according to this invention.

Referring to the drawing, and particularly FIG. 1, there may be seen an oil well 10. The well is somewhat schematic; and therefore, the casing and many other essential parts have not been shown for clarity. The eduction tube 12 extends from the surface of the ground to far beneath the ground. Reciprocating pump 14 includes a housing which is attached to the bottom of the eduction tube. Pump jack 16 forms means for reciprocating the pump 14 by sucker rod string 18. The sucker rod string 18 will include polish rod 20 at the surface of the earth, a long length of composite rod 22 of any type connected to the sinker bar 26. It will be understood that the composite rods 22 are not to be placed in compression, and the sinker bars are the metal bars of square or cylindrical cross section normally made of steel. As discussed above, the sinker bars normally have threaded pins 28 on each end which are connected to cups 30 on each end of rod units 32 which has a flexible segment 60 (FIGS. 10 and 2).

Those with ordinary skill in the art will recognize that the structure described to this point is old and well known to the oil well producing arts.

As illustrated, the rod units 32 will have the cup or coupling 30 on each end of thereof. FIG. 10 shows the detail of the coupling pin 28 of the sinker bar 26. As is well known, the couplings or cups 30 have a bore 34 therein. The bore has internal threads 36 along much of their length. These threads 36 mate with the external threads 38 upon a pin 28. The distal end of the cup 30 will have radial face 40. The proximal end of the pin 28 will have a maximum allowable outside diameter of the radial face 40. The increased diameter of the pin 28 increases the bending strength of the pin 28. The end of threads 38 upon pin 28 will be within the threaded portion 36 and the cup 30. I.e., the distance from the radial face 42 of the pin to the end 44 of the pin is less than the distance from the radial face 40 of the cup to the end of the threads 36 within the cup.

Immediately adjacent the radial face 42 is a cylindrical surface 46. This cylindrical surface is proximal of the threaded portion 38 of the pin 28. The cup 30 has a cylindrical bore 48 distal of the threads 36 which will be at the distal end of the bore 34. The diameter "D" of the cylindrical bore 48 is the same as the diameter "D" of the cylinder 46 (FIG. 10). Therefore, when the parts are threaded together, there will be a friction fit along the cylindrical portions 46 and 48 as well as along the radial faces 40 and 42. More important is that the friction fit along the cylindrical portions will be continuing. I.e., once there is any movement or unthreading of the pin 28 from the cup 30, the frictional fit between the radial faces 40 and 42 is lost. However, the frictional fit along the cylindrical surfaces between 46 and 48 continues for over one full revolution of the pin relative to the cup.

Those with skill in the art will realize that there is relative motion between the sucker rod string 18 and the oil or other fluid within the eduction tube 12. Therefore, it is desirable to have the outside diameter of the cup 30 as small as possible so that there is as little friction or viscosity lost with the movement of the sucker rod relative to the fluid. However, for the purposes of strength, this outside diameter cannot be reduced beyond certain designed diameters. Therefore, it is desirable that the diameter not be worn away by contact with the eduction tube 12. Therefore, I have provided a bearing 50 on each of the rod units 32.

Figure 3:
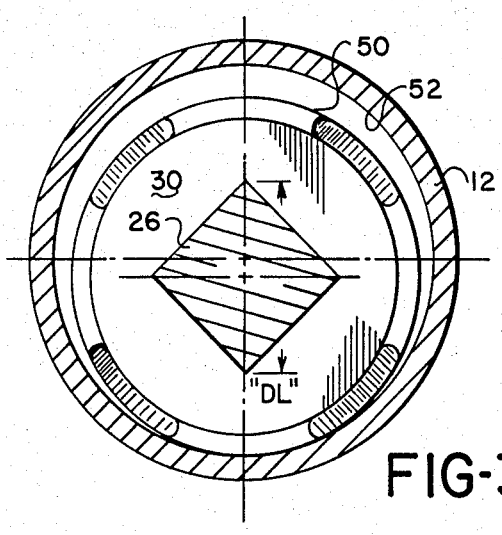
FIG. 3 is a cross sectional view taken substantially on line 3—3 of FIG. 2 showing a square profile sinker bar only.
Figure 4:
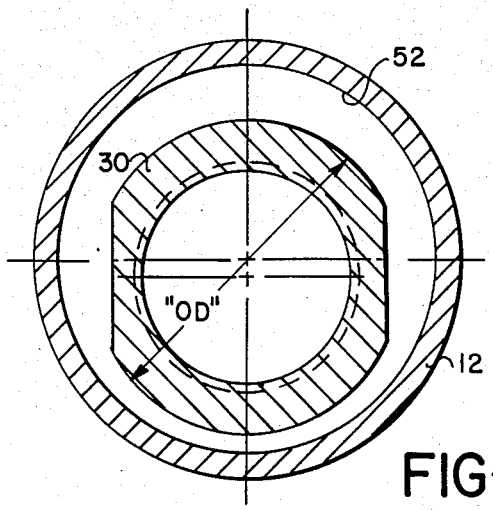
FIG. 4 is a cross sectional view taken substantially on line 4—4 of FIG. 2.
Figure 5:
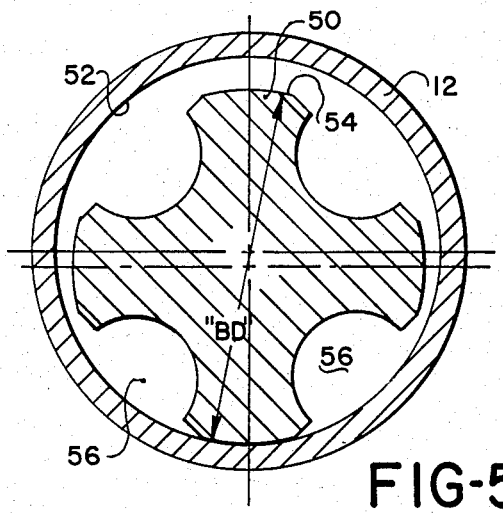
FIG. 5 is a cross sectional view taken substantially on line 5—5 of FIG. 2.

To understand the relationship of the bearing 50, reference is made to FIGS. 3, 4, and 5. Each of these figures show the eduction tube 12 having an inside wall 52 of a particular inside diameter. FIG. 3 shows a sinker bar 26 within the eduction tube 12. It will be noted that the sinker bar 26 has a certain diagonal length "DL" which is the largest measurement across its cross section. Obviously this "DL" must be less than the inside diameter of the eduction tube 12; however, it is desired that it be as large as possible so that the sinker bar 26 has as great of weight as possible, since this is the function of the sinker bars. The "DL" is limited by the trueness of the eduction tube 12. I.e., if the eduction tube 12 is not exactly round or is bent or curved that the sinker bars may rub against one of the walls inside surfaces 52 of the eduction tube 12.

FIG. 4 shows the connection or cup 30 within the eduction tube 12, that being the same eduction tube with an inside wall surface 52 having an inside diameter. The cup also will have a outside diameter "OD". The limitations of the "OD" were discussed above.

FIG. 5 shows the bearing 50. The bearing 50 will have as large a diameter as possible that will slide within the eduction tube 12. I.e., it will definitely have a larger diameter than the "DL" of the sinker bar 26 or the "OD" of the cup 30. The bearing diameter is shown in the drawing as "BD".

As stated before, the bearing 50 has an outer perimeter or outer contact surface 54 which is cylindrical. The diameter "BD" of this outer perimeter or cylindrical envelope will be only slightly smaller than the inside diameter is the inner wall or surface 52 of the eduction tube 12.

For the passage of fluids around the bearing 50, i.e., between the bearing and the inside surface 52, it is necessary to have a plurality of grooves 56. I prefer to use four grooves. The grooves will have about half the space of the perimeter so that only about 50% of the surface of the bearing 50 touches the cylindrical envelope and the other half is occupied by the groove 56.

The friction loss of the fluid going through the four grooves 56 is, by design, less than the friction loss of the fluid passing by the cups or couplings 30. Frictional fluid loss passing by the square cross sectioned sinker bars 26 is less than the friction loss going through the grooves 56 and less than the friction loss passing couplings 30.

As seen in FIG. 2, the preferred form of each groove 56 is helical except where cost is concerned. It will be understood to produce a helical groove 56 as seen in FIG. 2 requires an expensive machining process; namely, lath milling.

Figure 7:
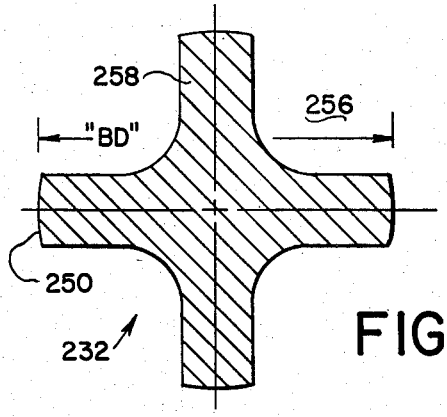
FIG. 7 is a cross sectional view of the embodiment of FIG. 6 taken substantially on line 7—7 of FIG. 6.
Figure 6:
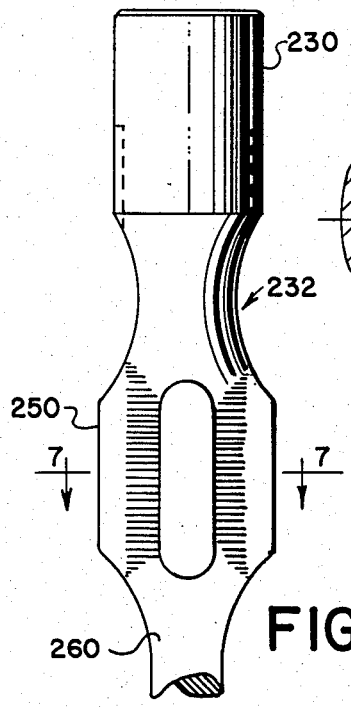
FIG. 6 is an elevational view of a portion of a modified rod unit as show in FIG. 1.

From a cost standpoint, for large production, the preferred form would be a forged or machined rod unit as seen in FIGS. 6 and 7. In this case, the main outline of the rod unit 232 is forged or machined. Like the other embodiment of rod unit 32, the forged or machined rod unit would have a coupling 230 which is, in the finished product, identical to the coupling unit 30 described heretofore. Also, the forged or machined unit would have a flexible segment 260 that will be described hereafter. Although it might be described that the bearing 250 of the second embodiment has a cylindrical outline with grooves 256, it may be seen that it may also be more of a core with four lugs 258 projecting therefrom. Lugs 258 would project from the central core so that they have the same maximum bearing diameter "BD", as previously described.

Figure 8:
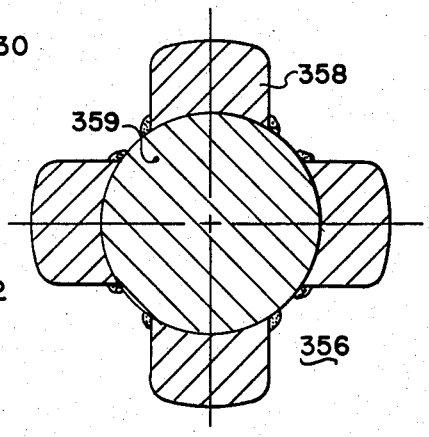
FIG. 8 is a cross sectional view of yet another embodiment similar to the embodiment of FIG. 7.

For the preferred embodiment, for the least expensive to build for a small number of units, would be the embodiment shown in FIG. 8. It likewise would have lugs 358 on a central core 359. However, in the case of the embodiment shown in FIG. 8, the lugs would be welded to the central core, but the result, except for the integral forging for the embodiment of FIGS. 6 and 7 and the welded fabricated model of FIG. 8 would be the same. I.e., there would, in effect, the grooves 356 between the lugs.

The flexible segment 60, is the same flexible element as 260 in the second embodiment. It is a segment which is 1" in diameter, and it is integral to one of the couplings 30 on one end and to the bearing 50 on the other end, the bearing 50 being connected to the other coupling or cups 30. In a typical installation the flexible segment will be 11" in length. Although a steel bar 1" in diameter and 11" in length might not normally be considered flexible, it will be understood that its flexibility is compared to the sinker bars having a square or cylindrical cross-section and a diagonal length or diameter of the sinker bar size.

The embodiment shown and described above is only exemplary. We do not claim to have invented all the parts, elements or steps described. Various modifications can be made in the construction, material, arrangement, and operation, and still be within the scope of my invention.

It will be understood that not all the details of the equipment have been described. E.g., the wrench flats are provided as is standard and customary for parts of rod couplings, and the particular exact details of the threads have not been particularly described such as they are well within those having ordinary skill in the art to provide the different thread details. Also, the different rod segment have smooth transition from one cylindrical size to the next, have not been described in detail. However, it will be understood that such are provided to avoid concentrated stress areas and fluid flow turbulence. Furthermore, those with ordinary skill in the art will understand that shear elements are provided in some specific locations, and also the rod unit is described is of satisfactory for the attachment of fishing tools in the event some of the structure fails and it is necessary to fish for the parts remaining in the well.

It will be understood that the surfaces of the bearing are hard surfaces to provide reduced friction and reduced wear upon the bearing surfaces. In the case of the embodiment of FIG. 8, the entire lugs could be made of suitable hard material. In the other embodiments, the surface of the lugs or the bearing contact might be specially treated.

The limits of the invention and the bounds of the patent protection are measured by and defined in the following claims. The restrictive description and drawing of the specific examples above do not point out what an infringement of this patent would be, but are to enable one skilled in the art to make and use the invention.

As an aid to correlating the terms of the claims to the exemplary drawing, the following catalog of elements and steps is provided:

10—Oil Well
12—Eduction Tube
14—Reciprocating Pump
16—Pump Jack
18—Sucker Rod String
20—Polish Rod
22—Composite Rod
26—Sinker Bar
28—Threaded Pins
30—Cups
32—Rod Units
34—Bore
36—Internal Threads
38—External Threads
40—Radial Face
42—Radial Face
44—End
46—Cylindrical Surface
48—Cylindrical Bore
50—Bearing
52—Inside Wall (Surface)
54—Outer Contact Surface
56—Grooves
258—Lug
359—Central Core
60—Flexible Segment
"D"—Diameter
"DL"—Diagonal Length
"OD"—Outside Diameter
"BD"—Bearing Diameter

I claim as my invention:

1. In a deep well having:

a. an eduction tube with an inside diameter extending from the surface of the earth to far below the surface, b. a reciprocating pump housing attached to the bottom of the eduction tube, c. pump jack means at the surface for reciprocating the pump, d. a light sucker rod connected to the pump jack means and extending into the eduction tube, and e. a series of heavy sinker bars having a large cross sectional area in the eduction tube connecting the light sucker rod to the pump;

f. an improved integral metal flexible rod unit interconnecting the sinker bars comprising in combination with the above:

g. a coupling on each end of the integral metal flexible rod unit connecting the flexible rod unit to the contiguous sinker bar, h. a segment which is flexible as compared to the sinker bars connecting one of the couplings to i. an integral metal bearing adjacent to the other of the couplings, the bearing having k. a cylindrical surface with l. a diameter i. only slightly smaller than the inside diameter of the eduction tube thereby forming a sliding fit therewith, and ii. greater than the diameter of any other portion of the flexible rod unit and the sinker bar, and m. grooves in the cylindrical surface for the passage of fluid between in the eduction tube around the bearing.

2. The invention defined in claim 1 having all of the limitations a. through m. further comprising:

n. said sinker bars having bodies with a cross section, and o. the diameter of said flexible rod unit coupling greater than the largest measurement across the cross section.

3. The invention defined in claim 1 having all of the limitations a. through m. further comprising:

n. the space between the coupling and eduction tube forming a greater restriction to fluid flow than the grooves in the bearing.

4. The invention defined in claim 1 having all of the limitations a. through m. further comprising:

n. said grooves being helical.

5. The invention defined in claim 1 having all of the limitations a. through m. further comprising:

n. each of the couplings having a cup with internal threads, o. said string having a pin with external threads therein, mating with the internal threads of the coupling, p. said coupling having a distal portion having an internal cylindrical bore of a certain diameter, q. said pin having a cylindrical diameter proximal of said threads having the same certain diameter as the cup, r. a radial face upon the distal surface of the cup, and s. a radial face of the pin proximal the cylindrical portion of the pin, t. the distance from the radial face of the pin to the end of the pin being less than the distance from the radial face of the cup to the end of the threads within the cup, so that said radial faces make frictional contact when the string is made up.

* * * * *